United States Patent [19]

Unger

[11] 4,027,353

[45] June 7, 1977

[54] CLEANING APPARATUS, PARTICULARLY FOR CLEANING WINDOW PANES

[76] Inventor: Henry Morton Unger, No. 9, Lotharstrasse, 565 Solingen, Germany

[22] Filed: June 4, 1976

[21] Appl. No.: 692,716

[30] Foreign Application Priority Data

June 6, 1975 Germany ..... 2525201
Dec. 20, 1975 Germany ..... 2557768

[52] U.S. Cl. ..... 15/245
[51] Int. Cl.[2] ..... A47L 1/06
[58] Field of Search ..... 15/117, 121, 245, 250.36, 15/250.37, 250.38, 250.39, 250.40, 250.41, 250.42

[56] References Cited

UNITED STATES PATENTS 2,727,271 12/1955 Oishei et al. ..... 15/250.42
2,905,960 9/1959 Ward ..... 15/245

FOREIGN PATENTS OR APPLICATIONS 1,062,541 3/1967 United Kingdom ..... 15/245

*Primary Examiner*—Daniel Blum
*Attorney, Agent, or Firm*—John C. Smith, Jr.

[57] ABSTRACT

A cleaning apparatus, particularly for cleaning window panes, is fitted with a replaceable strip-shaped rubber wiping element, a U-section holding sheath accommodating the rear edge of the wiping element and, at the forward end of a handle for holding the cleaning apparatus, two clamping plates of which one is detachable and secures the wiping element in its holding sheath. The detachable clamping plate is formed at its transverse front edge with an inwardly angled tapering lip which engages between one side of the holding sheath and the wiping element, and which is provided on its outside flank with rib-like teeth extending transversely to the longitudinal axis of the lip.

2 Claims, 5 Drawing Figures

CLEANING APPARATUS, PARTICULARLY FOR CLEANING WINDOW PANES

BACKGROUND OF THE INVENTION

This invention relates to a cleaning apparatus, particularly for cleaning window panes, fitted with a replaceable strip-shaped rubber wiping element, a U-section holding sheath accommodating the rear edge of the wiping element and, at the forward end of a handle for holding the cleaning apparatus, two clamping jaws of which one is detachable and secures the wiping element in the holding sheath.

Such cleaning apparatus are well known in the art. In conventional cleaning apparatus the detachable clamping plate is formed at its front edge with at least one inwardly off-angled lip which presses on the wiping element and thus secures it in its holding sheath. However, experience has shown that the pressure applied to the wiping element is not sufficient to ensure a reliable fixation of the wiping element during use. It is liable to be displaced when one of its ends strikes a hard object, particularly when wetted with soapy water.

In another known form of construction one of the clamping plates is formed with obliquely off-angled edge portions which rise towards the clamping plate, the object of this arrangement being to force the wiping element further into its holding sheath and thereby to increase the specific surface pressure between the wiping element and its sheath and thus to prevent the wiping element from undesirably shifting in its sheath when one or the other of its ends is accidentally knocked. Again experience has shown that the desired object is not in practice achieved by off-angled projections of such a kind.

Another major drawback of the known cleaning apparatus is that the normal pressure applied to the wiping element during use causes the wiping element to be considerably deformed, its leading edge tending to be distorted. When the apparatus is then used it fails to remove the water from the window pane evenly across the entire width of the wiping element. Striated water residues remain which must be removed by further wiping.

Finally, the conventional method of securing the detachable clamping plate to the fixed clamping plate of the cleaning apparatus is complicated because it involves undoing a number of screws each time the wiping element is to be renewed. This requires the availability of a tool. However, a cleaning apparatus has already been proposed which makes use of a toggle lever device on the detachable clamping plate for engaging the other clamping plate. Such a lever mechanism is an additional component which must be specially fitted, and which adds to the cost of such a cleaning apparatus.

SUMMARY OF THE INVENTION

It is the object of the invention to avoid the abovementioned drawbacks and to provide a cleaning apparatus of the contemplated kind which offers many advantages both with respect to the manner of fixation of the wiping element in its holding sheath as well as to the manner of securing the detachable clamping plate to the fixed clamping plate.

To attain this object the present invention provides a cleaning apparatus, particularly for cleaning window panes, fitted with a replaceable strip-shaped rubber wiping element having front, rear and side edges, a U-section holding sheath accommodating the rear edge of the wiping element and, at the forward end of a handle for holding the cleaning apparatus, two clamping plates of which one is detachable and secures the wiping element in its holding sheath, the detachable clamping plate being formed at its transverse front edge with an inwardly angled tapering lip which engages between one side of the holding sheath and the wiping element, and which is provided on its outside flank with rib-like teeth extending transversely to the longitudinal axis of the lip.

The inwardly angled tapering lip on the transverse front edge of the detachable clamping plate of the cleaning apparatus secures the wiping element in its holding sheath by a wedging effect and prevents the wiping element from laterally shifting and from distorting. The wedging effect is assisted by the action of the rib-like teeth with which the inwardly angled tapering lip is provided, and which bite into the rear end of the wiping element.

According to another feature of the invention the detachable clamping plate may be provided on each lateral edge with a tab-like angled portion, whereas the other clamping plate is formed with corresponding cut-out recesses with which the tab-like angled portions are adapted to snap into engagement.

This method of connecting the two clamping plates of the cleaning apparatus is much simpler than the conventional method of using screws or a toggle lever arrangement since no additional fastening means are required. For the purpose of renewing the wiping element one side of the clamping plate can be lifted and this will cause the edge portions on the other side to disengage. The detachable clamping plate can be just as easily replaced by snapping it into engagement with the recessed edge portions of the fixed clamping plate.

BRIEF DESCRIPTION OF THE DRAWING

An embodiment of the invention will now be described by way of example and with reference to the accompanying drawing, in which.

DESCRIPTION OF THE PREFERRED EMBODIMENT

Figure 1:
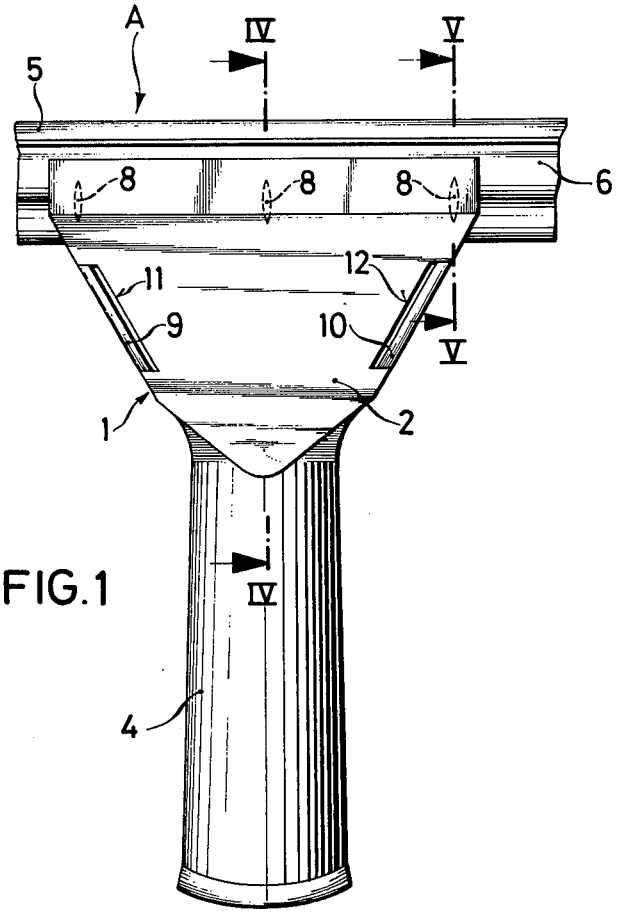
FIG. 1 is a top plan view of a cleaning apparatus according to the invention.
Figure 4:
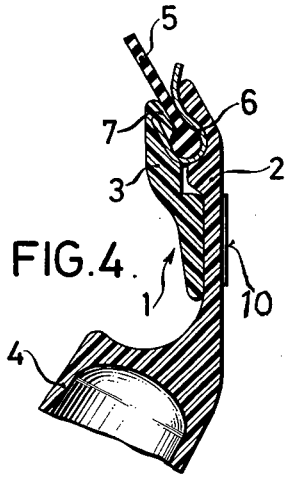
FIG. 4 is a fragmentary section of the cleaning apparatus taken on the line IV—IV in FIG. 1.

With reference to the drawing the illustrated cleaning apparatus comprises a holder 1 composed of two cooperating clamping plates, i.e. a fixed clamping plate 2 and a detachable clamping plate 3. The fixed clamping plate 2 extends rearwards, and forms a short handle 4. The clamping plate 2 and the short handle 4 are of integral construction. The short handle 4 is cylindrical and hollow, forming a socket for the insertion thereinto, if desired, of a longer handle. The reference numeral 5 denotes a replaceable strip-shaped rubber wiping element. The rear edge of this wiping element 5 is held in a U-section holding sheath 6 gripped between the two clamping plates 2 and 3.

Figure 5:
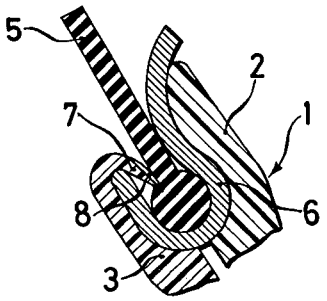
FIG. 5 is a fragmentary section of the cleaning apparatus taken on the line V—V in FIG. 1.
Figure 2:
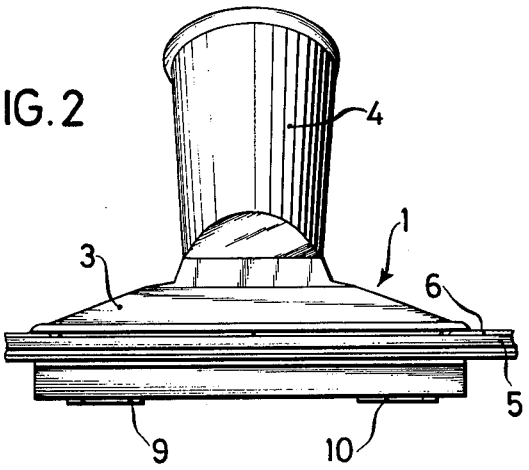
FIG. 2 is a view from the front in the direction indicated by A in FIG. 1.
Figure 3:
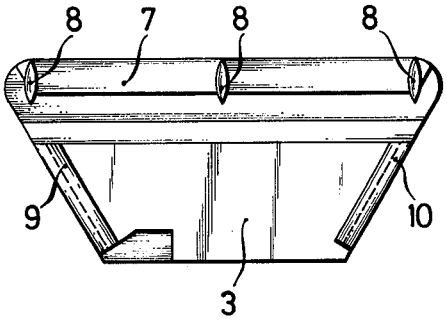
FIG. 3 is a top plan view showing the inner surface of the detachable clamping plate.

The transverse front edge of the detachable clamping plate 3 is formed across its entire width with an inwardly angled tapering lip 7. This lip 7 of the clamping plate 3 curls over the front edge of one side of the holding sheath 6 and bears against the corresponding side of the wiping element 5 which is thus gripped between the lip 7 and the other side of the holding sheath 6. The lip 7 of the clamping plate 3 is further armed on its outside flank with rib-like teeth 8 which bite into the wiping element 5 when the lip 7 of the clamping plate 3 wedges the wiping element 5 tightly into its sheath 6 (see FIG. 5). Furthermore, the clamping plate 3 is provided on each lateral edge with a tab-like angled portion 9 and 10 which engages a corresponding cut-out recess 11 and 12 in each edge of the other clamping plate 2. The tab-like angled portions 9 and 10 snap into the cut-out recesses 11 and 12 and thus reliably hold the two clamping plates 2 and 3 together.

The invention may be embodied in other specific forms without departing from the spirit or essential characteristics thereof. The embodiment is therefore to be considered in all respects as illustrative and not restrictive.

What is claimed is:

1. A cleaning apparatus, particularly for cleaning window panes, fitted with a replaceable strip-shaped rubber wiping element (5) having front, rear and side edges, a U-section holding sheath (6) accommodating the rear edge of the wiping element and, at the forward end of a handle for holding the cleaning apparatus, two clamping plates (2, 3) of which one is detachable and secures the wiping element in its holding sheath, the detachable clamping plate being formed at its transverse front edge with an inwardly and rearwardly directed tapering lip (7) which curls over the front edge of one side of the holding sheath and bears against the wiping element, and which is provided on its outside flank with rib-like teeth (8) extending transversely to the longitudinal axis of the lip, the teeth biting into the wiping element.

2. A cleaning apparatus according to claim 1, wherein the detachable clamping plate (3) is provided on each lateral edge with a tab-like angled portion (9, 10), whereas the other clamping plate (2) is formed with corresponding cut-out recesses (11, 12) with which the tab-like angled portions are adapted to snap into engagement.

* * * * *